US006769907B2

(12) United States Patent
Doud

(10) Patent No.: US 6,769,907 B2
(45) Date of Patent: Aug. 3, 2004

(54) OPEN FIRE DISPLAY APPARATUS WITH THERMAL EXPANSION FEATURE

(76) Inventor: Kevin Eugene Doud, 10 Argento, Mission Viejo, CA (US) 92692

( * ) Notice: Subject to any disclaimer, the term of this patent is extended or adjusted under 35 U.S.C. 154(b) by 2 days.

(21) Appl. No.: 10/321,248

(22) Filed: Dec. 16, 2002

(65) Prior Publication Data

US 2003/0113678 A1 Jun. 19, 2003

Related U.S. Application Data

(63) Continuation-in-part of application No. 10/027,952, filed on Dec. 19, 2001, now abandoned.

(51) Int. Cl.[7] ..... F23D 14/46

(52) U.S. Cl. ..... 431/350; 431/126; 431/77; 126/519

(58) Field of Search ..... 431/77, 125, 354, 431/266, 126, 350, 75, 78, 343, 171; 126/512, 519, 25 B

(56) References Cited

U.S. PATENT DOCUMENTS

| | | | | | |
|---|---|---|---|---|---|
| 876,444 | A | | 1/1908 | Eagon | |
| 885,495 | A | | 4/1908 | Lebwohl | |
| 919,430 | A | | 4/1909 | Herskovitz | |
| 924,689 | A | | 6/1909 | Rosengren | |
| 3,104,814 | A | * | 9/1963 | Boerder | 431/125 |
| 3,339,505 | A | * | 9/1967 | Bean | 126/25 B |
| 3,723,045 | A | | 3/1973 | Reese | |
| 3,824,984 | A | * | 7/1974 | Swanson et al. | 431/343 |
| 4,261,327 | A | * | 4/1981 | Kamin | 126/215 |
| 4,830,606 | A | | 5/1989 | Dillinger | |
| 4,867,191 | A | | 9/1989 | Walters | |
| 4,975,044 | A | | 12/1990 | Diederich | |
| 5,410,128 | A | * | 4/1995 | Vermillion et al. | 219/454.12 |
| 5,468,142 | A | | 11/1995 | Koziol | |
| 5,478,232 | A | | 12/1995 | Dillinger et al. | |
| 5,503,549 | A | | 4/1996 | Iasella | |
| 5,636,978 | A | | 6/1997 | Sasaki | |
| 5,868,128 | A | * | 2/1999 | Omar | 126/512 |
| 5,941,236 | A | * | 8/1999 | Byrne | 431/75 |
| 5,980,238 | A | | 11/1999 | Collins, Sr. | |
| D422,743 | S | | 4/2000 | Johnson | |
| D440,346 | S | | 4/2001 | Johnson | |
| 6,354,288 | B1 | * | 3/2002 | McDonald | 126/519 |
| 6,488,025 | B1 | * | 12/2002 | Cunningham | 126/92 AC |

FOREIGN PATENT DOCUMENTS

| | | | |
|---|---|---|---|
| EP | 0905438 A2 | | 3/1999 |
| JP | 3-168506 A | * | 3/1991 |

* cited by examiner

*Primary Examiner*—Josiah Cocks
(74) *Attorney, Agent, or Firm*—Gene Scott-Patent Law & Venture Group

(57) ABSTRACT

A fire display apparatus comprises a structural base plate supported in a horizontal attitude within a clay, or other fire resistant bowl. The base plate supports an annular burner tube on a outer, upwardly facing surface, the burner tube providing outwardly directed plural burner apertures adapted for directing flames in an outward direction. The base plate also supports a burner fence positioned in spaced-apart relationship with the burner apertures and adapted for directing the flames upwardly away from the outer face of the base plate. Burner gas is conducted to the space between the bowl interior and the underside of the base plate. Here, gas valves and a flame sensor provide automated flame monitoring and control. A system control unit is heat insulated using standoffs, an insulating mat and a heat cage.

14 Claims, 2 Drawing Sheets

OPEN FIRE DISPLAY APPARATUS WITH THERMAL EXPANSION FEATURE

RELATED APPLICATIONS

This is a continuation-in-part application of a prior filed and currently pending application having Ser. No. 10/027,952 and file date of Dec. 19, 2001 ABN which priority is claimed for matter herein common therewith.

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to fire systems for displays and spectacles, and more particularly to a compact fire display system for public viewing.

2. Description of Related Art

The following art defines the present state of this field:

Johnson, U.S. Des. Pat. No. 422,743 describes a light fixture combined shade and holder design.

Johnson, U.S. Des. Pat. No. 440,346 describes a light fixture housing design.

Eagon, U.S. Pat. No. 876,444 describes an incandescent lamp, the combination of a reservoir mantle support and a mantle support removably mounted and in communication therewith whereby the gas is fed in opposite directions through the mantle support.

Lebwohl, U.S. Pat. No. 885,495 describes a lamp, means for supporting a chimney, comprising outwardly extending arms, and arranged to support the chimney so that its lower edge is substantially at the level of the lowest part where combustion takes place and of a diameter not less than twice the outside diameter of that part of the burner where combustion commences, the space between said part and supporting means being substantially unobstructed except for said arms.

Herskovitz, U.S. Pat. No. 919,430 describes an inverted incandescent gas-lamp, an angle-shaped Bunsen tube, and a burner tube telescopically connected to the Bunsen-tube and having a depending tip portion provided with an inverted mantle whereby the latter is out of line with the air-intake, the telescopic connection of the tubes enabling the passage to the mantle to be lengthened or shortened for controlling the pressure of gas and for varying the distance of the mantle from the air-intake.

Rosengren, U.S. Pat. No. 924,689 describes a burner, the combination of a burner-tube having an internal groove at its upper edge, screen having its outer edge resting in said groove and removably held therein, a support within the tube having a plurality of feet, said screen being secured to the upper end of said support so it will be removably therewith, a ring within the tube on which the feet rest to removably hold the support in the tube, the support having a socket therein and a mantle post held in said socket.

Reese, U.S. Pat. No. 3,723,045 describes a selectively operable lighting system including a lamp for providing a flame of gas particularly suited for use in illuminating outdoor areas, such as patios, terraces and the like. The system is characterized by a tubular pillar supported by a rigid pedestal embedded beneath the surface of an area being illuminated, and surmounted by a burner connected with a source of gas encased within a protective and ornamental head. A selectively operable, electrically energizable igniter capable of responding to an absence of an illuminating flame is provided for igniting combustible gas delivered to the burner, whereby a substantially continuous illuminating flame selectively is provided.

Dillinger, U.S. Pat. No. 4,830,606 describes an outdoor-type gas lamp with a photovoltaic solar cell means, a rechargeable battery connected to the solar cell means, a normally-opened electromagnetic gas valve means, and an igniter means connected to both the photovoltaic solar cell means and the rechargeable battery means, with the photovoltaic solar cell means generating a bins voltage that closes the flow of illuminating gas through the gas valve means and blocks the flow of energy from the battery means to the igniter means when energized by daylight.

Walters, U.S. Pat. No. 4,867,191 describes a self-contained gas light control module including a tubular housing with a main tubular gas line extending through the housing and a normally open electro-mechanical valve in the gas line to permit flow of gas therethrough at night. During day light hours, a solar cell is activated to close the normally open electro-mechanical valve and shut-off the main tubular gas line; however, a smaller by-pass gas passageway or line is connected around the electro-mechanical valve to permit a smaller amount of continuous gas flow around the electro-mechanical valve, when closed, for low pilot flame burning of the gas light during day light hours.

Deidrich, U.S. Pat. No. 4,975,044 describes a mechanically durable, highly luminous mantle for a gas-powered light source.

Koziol, U.S. Pat. No. 5,468,142 describes a dimmer device for a gas light, which is solar activated, and is composed of a minimum number of parts. A magnetically operated valve with a magnetically attractable ball is energized during daylight hours to close off one passageway yet allows gas to flow through a second passageway at a lower flow rate to provide a dimmer condition for the lamp. At night time, the magnetic valve is deactivated causing the magnetically attractable ball to open the otherwise closed passageway and thereby allow full gas flow to the lamp. The dimmer device is easily installed into the lamp housing rather than the post.

Dillinger, U.S. Pat. No. 5,478,232 describes an outdoor lamp having a solenoid valve, which controls the feed of gas and mixed with air to an electrically conducting venturi table and thence to burner tips, which are surrounded by mantles. An electrode disposed adjacent to a slit in the venturi tube creates a spark adjacent to the slit when the valve is electrically opened to light the gas mixture which subsequently lights the gas mixture at the tips. An electrical circuit has a photocell array, which causes the electrical circuit to open the valve at dawn with a shot of electricity, and closes the valve at night with another shot of electricity. A sensor in the circuit detects when the lamp is lighted and discontinues the spark.

Iasella, U.S. Pat. No. 5,503,549 describes a turn down device for regulating gas flow within a gas lamp that is of the general type having a lamppost and a mantel. The device has a conduit configured to allow gas to flow therethrough and a gas supply line connected to the conduit for supplying gas under pressure. A poppet valve having a valve seat and a magnetic poppet is provided along the conduit downstream of where the supply line connects to the conduit. A solar cell is connected to the electromagnet that generates and provides to the electromagnet a voltage, which varies depending upon sunlight at the solar cell. The popper is fabricated so as to have a selected size, shape and mass such that the gas flow from the supply line lifts the poppet away from the valve seat absent attractive forces induced at an electromagnet provided proximate the valve. As varying amounts of sunlight are directed upon the solar cell, electricity travels to the windings of the electromagnet that induces an attractive electromagnetic force upon the valve. The electromagnetic force biases the valve a respective amount towards a closed position, thereby reducing gas flow through the valve. The device further includes a bypass supply line for providing a pilot flow of gas from the gas supply line to the conduit. A bypass valve is provided on the bypass supply line for adjusting the flow of gas through the bypass supply line so that a pilot flow of gas is maintained to the mantel when the valve is in the fully closed position.

Sasaki, U.S. Pat. No. 5,636,978 describes a gas burning power supply section for igniting gas including a secondary battery and a solar battery for charging the secondary battery, and the operating voltage from the power supply section is supplied to a gas ignition circuit, a flame detection circuit for detecting the flame after the gas is ignited, and a solenoid valve-controlling timer circuit for controlling the gas supply. A day/night discrimination circuit is provided in association with the power supply section, and the ignition circuit, the flame detection circuit and the timer circuit are individually set in operation in accordance with a day/night discrimination output during the nighttime. In the event the flame of burning gas goes out halfway, the timer circuit operates to perform a trial including re-igniting operation, and if the re-igniting fails during a trial period, the gas supply is automatically shut off.

Collins, U.S. Pat. No. 5,980,238 describes a gas light assembly having an electronic control system that monitors the surrounding ambient light conditions to detect the transition from a light to a dark state is disclosed. Upon detection of the transition of the ambient light to a dark state, the electronic control system opens a gas flow control valve to allow the flow of gas from a gas supply line through a mixing chamber wherein the gas is mixed with air to form a combustible gas mixture that passes through a venturi tube and a burner head assembly, exiting the burner head assembly at mantels. A spark is generated to ignite the combustible gas mixture passing out of the mantels, and a sensor detects and verifies the ignition of the combustible gas mixture at the mantels so as to verify to the system that the lamp of the gas light assembly is lit during dark conditions and is unlit and the flow of gas shut off during light conditions.

Yokoyama, EP 0905438 describes a globe supporting structure that supports a globe of a gas lantern which burns combustible gas discharged from a gas cartridge containing the combustible gas by means of a burner head located inside the globe, characterized by a ventilator positioned above the globe, a plurality of wires rotatably arranged on the ventilator, each of which rotates about the ventilator, and is shaped so as to be capable of reaching a bottom surface of the globe, and a globe supporting plate that supports the globe, and is provided with first means which is detachably engagable with a portion of the wires reaching the bottom surface of the globe. In accordance with the globe supporting structure, the globe can be removed easily from the globe supporting plate without breaking the globe.

The prior art teaches the use of flames for illumination, cooking, industrial heating and also for flame display, but does not teach an open flame pyro-display for spectacle in which the display is attractive and yet safely controlled through low-cost automation. The present invention fulfills these needs and provides further related advantages as described in the following summary.

SUMMARY OF THE INVENTION

The present invention teaches certain benefits in construction and use which give rise to the objectives described below.

A fire display apparatus comprises a structural base plate supported in a horizontal attitude within a clay, or other fire resistant bowl. The base plate supports an annular burner tube on a outer, upwardly facing surface, the burner tube providing outwardly directed plural burner apertures adapted for directing flames in an outward direction. The base plate also supports a burner fence positioned in spaced-apart relationship with the burner apertures and adapted for directing the flames upwardly away from the outer face of the base plate. Burner gas is conducted to the space between the bowl interior and the underside of the base plate. Here, gas valves and a flame sensor provide automated flame monitoring and control. A system control unit is heat insulated using standoffs, an insulating mat and a heat cage.

A primary objective of the present invention is to provide an apparatus and method of use of such apparatus that provides advantages not taught by the prior art.

Another objective is to provide such an invention capable of automatic safety monitoring and controlling of an open flame pyro-display.

A further objective is to provide such an invention capable of inherently safe operation.

A still further objective is to provide such an invention capable of automated control using heat rejecting techniques to keep a control unit relatively cool.

A yet further objective is to provide such an invention capable of accommodating heat expansion of metallic structures in contact with relatively fragile refractories.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
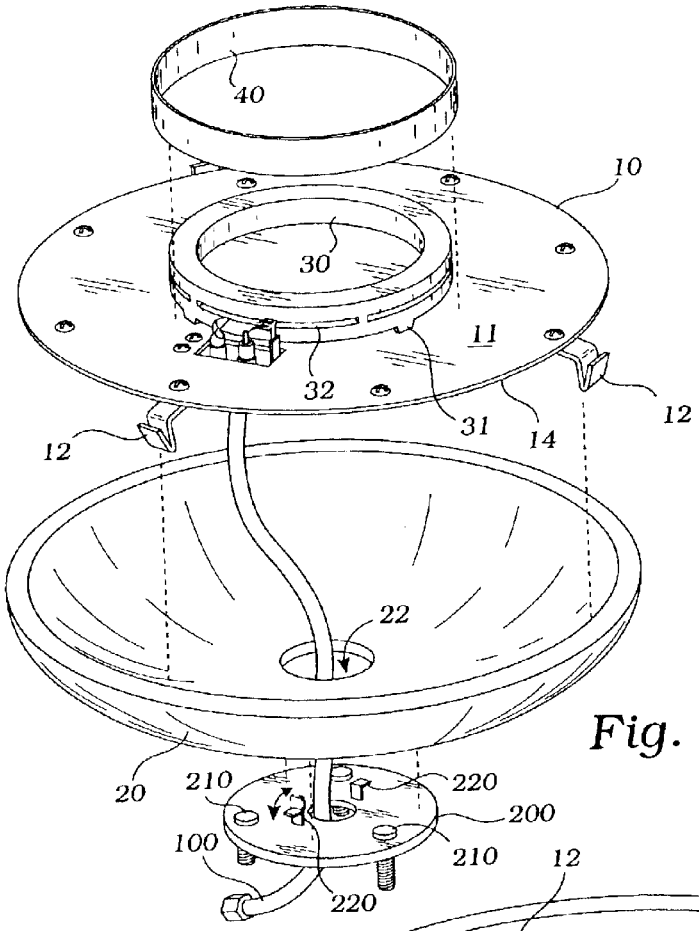
FIG. 1 is a perspective exploded view of the preferred embodiment of the invention.
Figure 2:
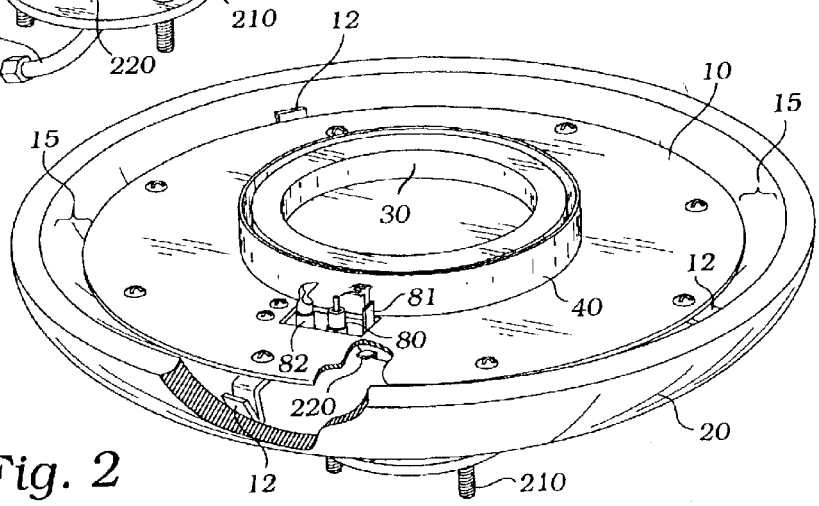
FIG. 2 is a perspective view thereof as assembled and ready for operation and with a cutaway portion to show the manner of interface between metal and refractory portions of the invention.

The present invention is a fire display apparatus comprising a base plate 10, of structural steel supported in a horizontal attitude within a bowl 20, as shown in FIG. 2. The bowl 20 is preferably made of a refractory such as clay, silica, magnesite, dolomite, alumina, chromite or similar materials such as refractory concrete and refractory metals. The bowl 20, may in fact, be as shown in the figures, but may also be a concavity of any type, or a simple depression of any shape. In this discussion, no matter what configuration or shape, we shall refer to this element by the term, "bowls" and by this is meant any shaped receiver of the base plate 10. The bowl 20 preferably has a convergent inside surface as best shown in FIG. 1.

The base plate 10 is preferably disk shaped, but may also be square or rectangular, oval, etc. and is of a heavy gauge material for resisting thermal warping. The base plate 10 supports an annular hollow burner ring 30, which, as shown in FIG. 1, is preferably square in cross-section, but may take alternate shapes, and this ring 30 is mounted on an outer face 11 of the base plate 10. Preferably, the ring 30 is mounted on feet 31 to avoid excessive thermal exchange with the face 11. Such feet 31 are preferably thermal insulators of ceramic, etc. The burner ring 30 provides plural outwardly directed burner apertures 32 adapted by their position for directing flames in a peripheral, horizontal, outward direction. These apertures 32 may be holes or slots as shown. A burner fence 40, of heat resistant material such as stainless steel, is positioned in a spaced-apart relationship with the burner apertures 32 and is positioned and sized for directing the flames in an upward direction away from the outer face 12 of the base plate 10. The burner fence 40 prevents ambient wind currents from blowing the flame out and provides some stability to a pilot flame. Preferably, the various parts of the burner ring 30 and the fence 40 are made of structural steel of an alloy that maintains its strength and shape when temperature cycled.

Figure 3:
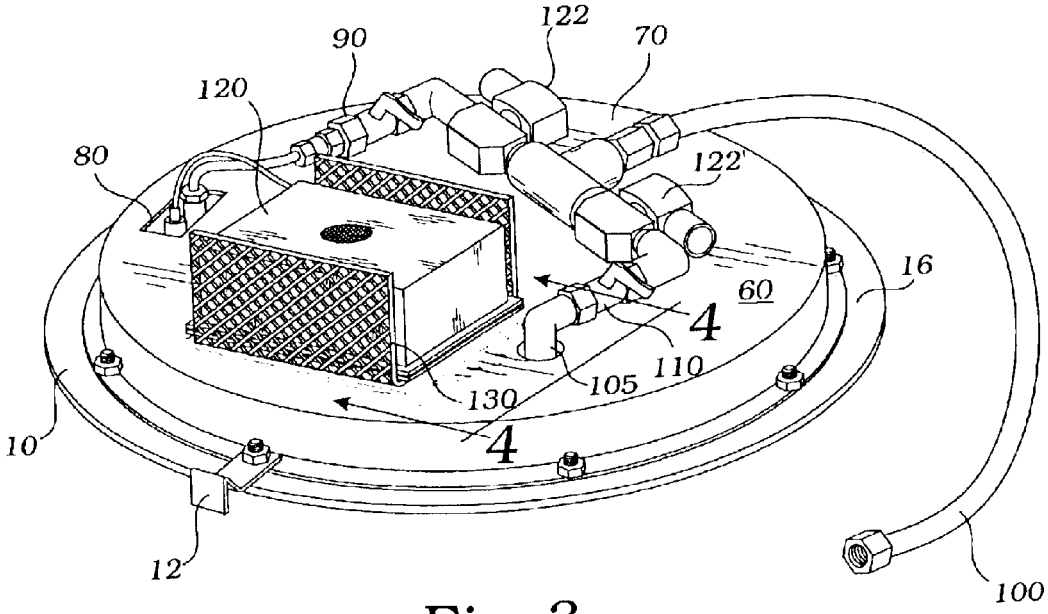
FIG. 3 is a perspective view thereof showing the bottom of a base plate of the invention and positions of operating components thereof.
Figure 4:
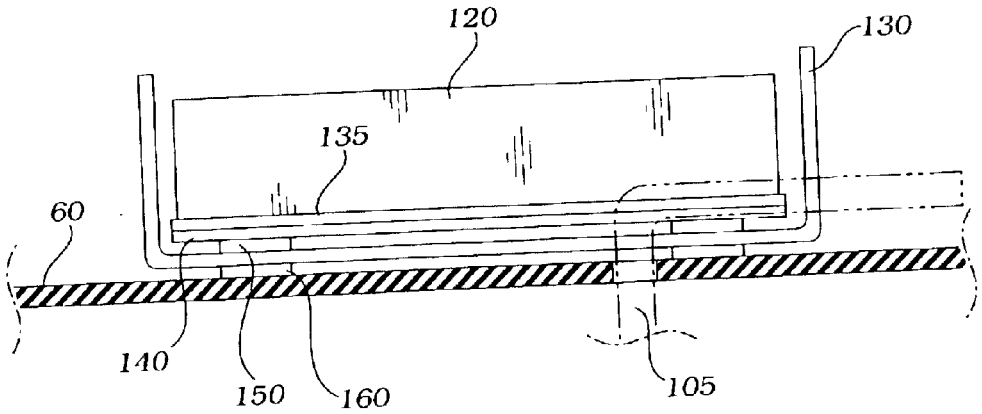
FIG. 4 is a partial side elevational view of a control module thereof taken along line 4—4 in FIG. 3.

As shown in FIG. 1 the bowl 20 provides at least one drain hole 22, preferably at bottom center. Further, the base plate 10 provides spring legs 12, or a similar resilient or spring like device, i.e., resilient means, mounted peripherally in radial positions for resting the base plate 10 within the bowl 20. The primary function of the spring legs 12 is to allow thermal expansion of base plate 10 without causing excessive stress generating forces on the bowl 20 which might cause the bowl 20 to crack. The legs 12 simply rest, as shown in FIG. 2, on the inside surface of bowl 20. The bowl 20, being a refractory material such as clay, has a very low thermal coefficient of expansion, while the metal parts have a relatively high such coefficient. Thus, with temperature rise, the base plate will become larger in girth and such expansion is taken up by the spring legs 12. The spring legs 12 also enable a peripheral gap 15 to exist around the base plate 10 so as to enable water to drain into the bottom of the bowl 20 while allowing air flow upward along the sides of the bowl 20. The bowl 20 drains through its central hole 22. This can be important when water displays are positioned near the invention, or when the invention is placed in the open and thus subject to receiving rain. Thus water does not collect in the bowl 20 and on the base plate 10. The peripheral gap 15 is also important should a gas leak occur within the bowl 10 below the base plate 10, because the gas, being lighter than air, is able to vent through the peripheral gap 15 where it is burned. The base plate 10 further provides and supports, a sub-plate 60, as shown in FIG. 3, mounted in spaced apart relationship onto an inner face 16 of the base plate 10. This spacing is preferably filled with insulation material allowing the sub-plate 60 to operate at a lower temperature than the base plate 10 and to therefore successfully carry several temperature sensitive devices mounted on it. This will become clear in the further description below.

As shown in FIG. 3, a gas supply manifold 70 is mounted on the sub-plate 60 and is adapted for gas delivery through supply line 100, to a flame igniter pilot 80 through a pilot gas flow adjusting valve 90, and to the annular burner tube 30 through a burner gas flow adjusting valve 110 and burner inlet pipe 105. It is noticed that gas enters the invention through the drain hole in the bowl via the supply line 100. A flame safety control module 120 controls solenoid valves 122 and 122' adapted for controlling gas flow to the burner gas flow adjusting valve 110 and also to the pilot gas flow adjusting valve 90, respectively. Electrical interconnect wiring between the control module 120 and the solenoid valves 122, 122' is not shown for clarity in the figures and since such wiring is well known in the art. A flame monitor sensor 81, well known in the art, is positioned adjacent to the pilot 80; it provides a signal to the control module 120 for shutting the solenoid valves 122, 122' when a flame signal is lost.

In order to employ a low cost control module 120, it is necessary to keep its temperature from rising above about 180 degrees F. The critical solution to this is to mount the module 120 on a thermal insulator mat 135; for instance one made of rubber, which, in turn, is supported by a structural plate 140, mounted on first insulating feet 150 within a U-shaped cage, preferably of expanded metal which admits cooling air flow and tends to reflect radiant heat away from the module 120. The U-shaped cage is then mounted on second insulating feet 160 onto the sub-plate 160. This arrangement provides adequate thermal isolation to the control module 120. It is clear that such a simple control module 120 is well known in the art and may, for instance, be of the type described in Dillinger '232 or Sasaki 978'.

Should a greater flame volume be desired burner apertures may be also placed facing inwardly in burner tube 30. The primary reason for placing the apertures 32 on the sides of the burner tube 30 is to minimize the amount of rain or sprinkler water that may enter the tube 30. The apparatus preferably also includes a spacer plate 200, as shown in FIG. 1, upon which the bowl 20 is rested on plural spacers 210 separating the bowl 20 from the spacer plate 200 and which allow a flow of outside air to move under the bowl 20 and into the bowl 20 through the central hole 22 for cooling the various components including the control module 120. This is an important feature critical for cooling. The spacer plate 200 preferable provides upwardly directed fingers 220 which engage the central hole 22; centering the bowl 20 on the spacer plate 200 and anchoring the bowl 20 when the fingers are bent over as shown in FIG. 1. The spacers may be separate washers or may be bumps pressed into the spacer plate 200 or equivalent structural members.

Operation of the invention includes: directing gas flow to the invention through line 100, opening solenoid 122 and valve 90, lighting the pilot 80 through the flame safety monitor sensor 81, sensing a pilot flame at the electrode spark igniter 82, energizing the solenoid valve 122' to allow gas to flow to ring 30. Pilot flame size is adjusting by pilot gas flow, i.e., adjusting valve 90. Burner flame size is controlled by the burner gas flow adjusting valve 110. If the main flame is lost, as by blowout or drown-out, the sensor signal is lost and the solenoid valve 122' closes down gas flow to the burner. When the pilot is relit, the sensor detects the flame and the main burner is once again operated.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fire display apparatus comprising: a base plate with spring legs extending radially therefrom, the spring legs resting in simple contact with a downwardly convergent interior surface of a refractory bowl, the base plate engaging: (i) an annular, hollow, burner ring having plural burner apertures positioned for directing flames in a radially, outward direction; and (ii) a burner fence positioned in spaced-apart relationship with the burner apertures for turning the flames upwardly.

2. The apparatus of claim 1 wherein the spring legs enable an annular gap between the interior surface of the refractory bowl and the base plate.

3. The apparatus of claim 1 wherein the base plate provides a sub-plate mounted in spaced apart relationship onto an inner face of the base plate.

4. The apparatus of claim 3 further comprising a gas supply manifold mounted on the sub-plate and adapted for gas delivery to a flame igniter pilot through a pilot gas flow adjusting valve, and to the annular burner ring through a burner gas flow adjusting valve.

5. The apparatus of claim 4 further comprising a flame safety module engaged for control with a solenoid valve adapted for admitting gas to the burner gas flow adjusting valve.

6. The apparatus of claim 5 further comprising a flame monitor sensor adapted for shutting the solenoid valve when a flame signal is lost.

7. The apparatus of claim 3 further comprising a control unit mounted on the sub-plate and interconnected for control of flame operations.

8. The apparatus of claim 7 wherein the control unit is mounted on a thermal insulator.

9. The apparatus of claim 8 wherein the thermal insulator is mounted on a support plate.

10. The apparatus of claim 9 wherein the support plate rests on first insulating feet within a U-shaped cage.

11. The apparatus of claim 10 wherein the U-shaped cage rests on second insulating feet on the sub-plate.

12. A fire display apparatus comprising: a base plate supported in a generally horizontal attitude within a refractory receptacle, the base plate engaging thereon: (i) an annular hollow burner ring on a outer face of the base plate, the burner ring providing plural burner apertures positioned for directing flames in a radially, outward direction; (ii) a burner fence positioned in spaced-apart relationship with the burner apertures for turning the flames upwardly; and (iii) a compliant resilient means attached on the base plate for resting the base plate on a convergent inside surface of the refractory receptacle.

13. The apparatus of claim 12 further comprising a spacer plate engaged with a central hole of the refractory receptacle, the receptacle spaced apart from the spacer plate by plural spacers, whereby air flow is able to move between the spacer plate and the receptacle and into the central hole for cooling the apparatus.

14. A fire display apparatus comprising: a base plate with spring legs extending radially therefrom, the spring legs engaging a refractory bowl in such manner as to create a gap between the bowl and the base plate, the base plate engaging: (i) an annular, hollow, burner ring having plural burner apertures positioned for directing flames in a radially, outward direction; and (ii) a burner fence positioned in spaced-apart relationship with the burner apertures for turning the flames upwardly; a gas supply manifold interconnected for gas delivery to a flame igniter pilot through a pilot gas flow adjusting valve, and to the annular burner ring through a burner gas flow adjusting valve.

* * * * *